United States Patent [19]

Abe et al.

[11] Patent Number: 4,483,656

[45] Date of Patent: Nov. 20, 1984

[54] VORTEX BLOWER

[75] Inventors: Masahiro Abe, Chiba; Katsuo Motosaka, Narashino, both of Japan

[73] Assignee: Hitachi, Ltd., Tokyo, Japan

[21] Appl. No.: 451,092

[22] Filed: Dec. 20, 1982

[30] Foreign Application Priority Data

Dec. 18, 1981 [JP] Japan ..... 56-203399

[51] Int. Cl.[3] ..... F04D 29/34

[52] U.S. Cl. ..... 415/53 T; 415/55; 60/366

[58] Field of Search ..... 415/53 R, 53 T, 55, 415/56, 57, 58, 213 T, 212; 60/366

[56] References Cited

U.S. PATENT DOCUMENTS

| | | | |
|---|---|---|---|
| 2,692,560 | 10/1954 | Zeidler | 415/175 |
| 2,983,432 | 5/1961 | Tupper | 415/146 |
| 2,989,284 | 6/1961 | Corbett | 415/212 |
| 3,145,535 | 8/1964 | Schneider | 60/366 |
| 3,355,095 | 11/1967 | Hollenberg | 415/119 |
| 3,356,033 | 12/1967 | Ullery | 415/212 |
| 3,542,496 | 11/1970 | Bergeson | 415/143 |
| 4,247,246 | 1/1981 | Abe et al. | 415/53 T |

FOREIGN PATENT DOCUMENTS

| | | | |
|---|---|---|---|
| 47904 | 4/1979 | Japan | 415/53 R |
| 84248 | 9/1956 | Netherlands | 415/53 T |

*Primary Examiner*—Henry C. Yuen
*Assistant Examiner*—John Kwon
*Attorney, Agent, or Firm*—Antonelli, Terry & Wands

[57] ABSTRACT

A vortex blower having an impeller provided with an annular recess laterally opening around an axis of rotation, a casing disposed so as to face the impeller and cover a radially outer portion of the impeller, an arcuate recess formed around the rotation axis in a portion of the casing which extends between a suction port and a discharge port and opposes to the annular recess, and a plurality of blades provided in the annular recess to divide the recess into a plurality of circumferentially arranged pockets, each having a radially outer end extending towards the arcuate recess beyond the annular recess. The vortex blower having such a construction can operate safely even when drawing air in which dust is suspended.

13 Claims, 4 Drawing Figures

VORTEX BLOWER

BACKGROUND OF THE INVENTION

1. Field of the Invention

The present invention relates to vortex blowers, and more particularly, to a vortex blower which eliminates deposition of dust to an inner wall surface of an outer peripheral wall in a vicinity of end portions of blades to thereby reduce the vibration of an impeller due to mass unbalance.

2. Description of the Prior Art

Generally, an impeller of a blower is rotated at an extremely high speed. Therefore, if there is any mass unbalance, the impeller will be vibrated to cause various problems such as, for example damage to mechanical rotor shaft or the impeller, overheating or seizure in the bearings, excessively loud noise and so forth, resulting in a deterioration of the durability of the blower. The vibration also produces noises which seriously deteriorates the working condition or environment.

An example of vortex blowers is disclosed in U.S. Pat. No. 3,355,095. This vortex blower has an annular recess, formed in an impeller and laterally opening around an axis of rotation, a casing arranged to cover the impeller, a suction port and a discharge port formed in the casing, an arcuate recess formed in a portion of the casing which extends between the suction port and the discharge port and opposes to the annular recess, and a plurality of blades mounted in the annular recess. In the operation of the vortex blower of the type described, the air trapped between adjacent blades in the annular recess is displaced from the radially inner portion of the impeller to the radially outer portion thereof by the centrifugal force produced by rotation of the impeller. The flow of air is progressively accelerated as it approaches the radially outer portion of the impeller and is oriented or deflected to flow into the radially outermost portion of the arcuate recess along the inner wall surface of the impeller. In addition, the air which has been introduced into the radially outermost portion of the arcuate recess flows along the inner wall surface of the arcuate recess and is directed to flow from the radially innermost portion of the arcuate recess again into the radially inner portion of the arcuate recess. This movement of the air is continued until the air is discharged from the blower, and thus the air in the casing is repeatedly accelerated by the impeller repeatedly, so that it is possible to attain a high discharge pressure.

In this type of vortex blower, a dust separation or filtration device is disposed at the suction port of the vortex blower, particularly when the blower is used in the air suspending dust. It is, however, extremely difficult to completely remove the dust even with the aid of such a separation or filtration device, and the vortex blower is more or less still subjected to such dust. As the air suspending dust is sucked by the vortex blower, the dust particles are separated by the centrifugal force when the radial flow of air is forcibly changed into axial flow at the radially outermost portion of the impeller, and the dust particles thus separated are deposited on the inner wall surface of the radially outermost portion of the impeller.

Once the deposition of dust takes place, it grows to form a thick layer of dust on the inner wall surface of the radially outer portion of the annular recess. Then, the thick layer of dust is partially separated and drop during rotation of the impeller to produce a mass-unbalance of the impeller which, in turn, causes a heavy vibration of the impeller. Furthermore, the aerodynamic performance of the blower is seriously damaged due to a reduction in the area of air passage attributable to the deposition of dust. In order to remove the dust deposited on the impeller, it has been necessary to disassemble and clean the blower.

Another type of vortex blower is disclosed, for example, in the specification of U.S. Pat. No. 4,247,246 and Japanese Laid-Open No. 120207/1974. In this vortex blower, the deposition of dust is effectively avoided due to the construction which permits air to be discharged radially outwardly from the impeller or in a direction in which centrifugal force acts on dust. This vortex blower, however, requires a sufficient space for surrounding the impeller at the radially outer side and lateral side thereof for changing the flow direction of air. It is, therefore, not possible to preserve a large volume of the annular space in the impeller as compared with the arcuate recess of the casing. According to this arrangement, therefore, it is difficult to attain higher performance of the blower, because the blade area is inevitably smaller as compared with that in the vortex blower of the first-mentioned type.

On the other hand, Japanese Patent Publication No. 33856/1971 discloses another type of vortex blower in which a large area is preserved for the impeller blades with respect to the arcuate recess while effectively preventing the attaching of dust. In this vortex blower, a plurality of semi-circular blades, radially projecting from the impeller are disposed in an annular air passage having a circular cross-section. This vortex blower exhibits a performance equivalent to that achieved by the vortex blower explained above free from the problem of deposition of the dust. In this vortex blower, however, it is necessary to attach the impeller blades at a high precision and to maintain sufficient strength of attaching of the blades, because the impeller faces the inner surface of the casing with an extremely small gap. Namely, in order to avoid mechanical interference between the stationary part and the impeller which rotates at an extremely high speed, it is essential to finish the blade at a high precision. Also, a reinforcement member may be attached to each blade in order to withstand a large stress generated during the rotation of the impeller. This reinforcement member often disturbs the flow of air in the casing.

SUMMARY OF THE INVENTION

Accordingly, an object of the invention is to provide a vortex blower capable of continuing operation at a high efficiency even if air suspending a slight dust is drawn into the blower.

To this end, according to the invention, there is provided a vortex blower comprising: a rotor shaft having an axis of rotation; an impeller fixed to the rotor shaft; an annular recess formed in the impeller and laterally opening around the rotation axis; a casing disposed to face the impeller and cover a radially outer portion of the impeller; a suction port and a discharge port formed in the casing; an arcuate recess formed around the rotation axis in a portion of the casing which extends between the suction port and the discharge port and opposes the annular recess; and a plurality of blades provided in the annular recess to divide the annular recess into a plurality of circumferentially arranged pockets and each having a radially outer end portion extending towards the arcuate recess beyond the annular recess.

Other objects, features and advantages of the invention will become clear from the following description of the preferred embodiments taken in conjunction with the accompanying drawings.

DESCRIPTION OF THE PREFERRED EMBODIMENTS

Figure 2:
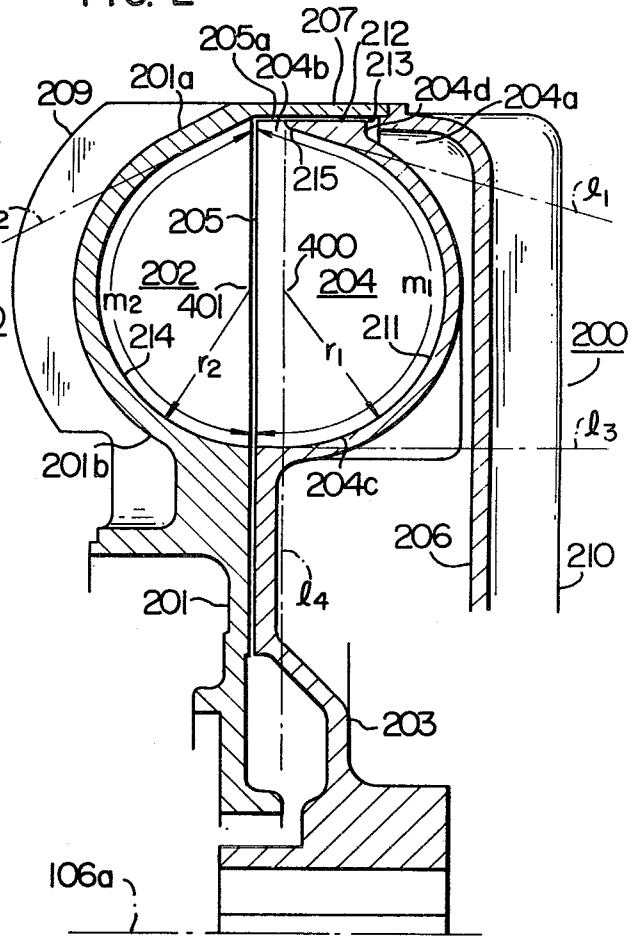
FIG. 2 is a sectional view, on an enlarged scale, of a part of the vortex blower of the embodiment shown in FIG. 1.
Figure 1:
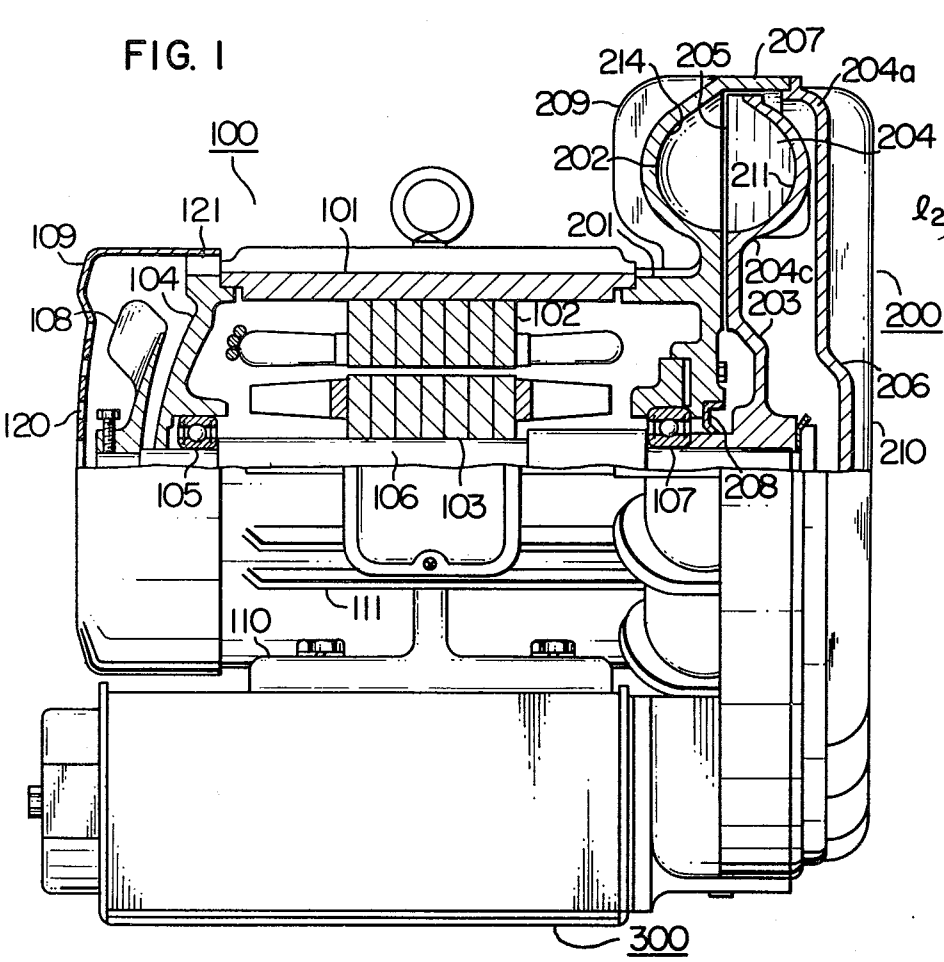
FIG. 1 is a partial sectional view of a vortex blower connected to an electric motor, in accordance with an embodiment of the invention.

Referring now to the drawings wherein like reference numerals are used throughout the various views to designate like parts and, more particularly, FIGS. 1 and 2, according to these Figures, a vortex blower generally designated by the reference numeral 200 is connected to an electric motor generally designated by the reference numeral 100 and is provided with a silencer generally designated by the reference numeral 300 disposed beneath the electric motor 100. More specifically, the electric motor 100 has a cylindrical housing 101 opened at both ends and accommodating a stator 102, with a rotor 103 being disposed inside the stator 102 with an annular gap left therebetween. The rotor 103 includes a rotary shaft 106 having an axis of rotation 106*a* passing through the center of the rotor 103. An end portion of the rotor shaft 106 opposite to a load is rotatably supported by a bearing 105 fitted in an end bracket 104 closing one end of the housing 101, while the other end portion of the rotor shaft 106, closer to the load, is rotatably supported by a bearing 107 fitted in a common casing 201. The common casing 201 which closes the other end of the housing 101, will be explained in more detail hereinbelow. The rotary shaft 106 extends through the end bracket 104 and is connected with a cooling fan 108 at one end thereof opposite to the load, with an end cover 109 covering the cooling fan 108. As the cooling fan 108 rotates, it draws air through air intake ports 120 formed in the end cover 109, with the air being discharged along an outer surface of the housing 101 through air discharge ports 121 formed in the end cover 109.

A common casing 201 of the vortex blower 200 is provided, at its radially outer portion, with an arcuate recess 202 shaped in a circular arc around the axis of rotation 106*a*. The common casing 201 is disposed to cover an impeller 203. The impeller 203 has, at a portion opposing the arcuate recess 202 of the common casing 201, an annular recess 204 which laterally opens around the axis of rotation 106*a*. The annular recess 204 is divided in a circumferential direction into a large number of small spaces or pockets by a plurality of semi-circular blades 205 radially arranged in the annular recess 204. The impeller 203 is connected to the load side of the rotor shaft 106 which extends through the common casing 201. The common casing 201 has a peripheral wall 207 which extends over a radially outermost portion of the impeller 203 and constitutes a part of the common casing 201. A cover 206 is secured to the peripheral wall 207 to cover the impeller 203. A dust seal 208 is attached to a portion of the common casing 201 adjacent to the bearing 107 and near to the impeller 203 to prevent dust from coming into the bearing 107 from the impeller 203. Furthermore, the arcuate recess 202 is communicated with a suction port and a discharge port (not shown) arranged at opposite sides of a partition wall (not shown) provided at a lower portion of the common casing 201. The suction port and the discharge port are connected with the silencer 300, with an upper surface of the silencer 300 being connected to a base provided on a lower side of the housing 101. Heat radiating ribs 111, 209 and 210 are provided on the cylindrical outer surface of the housing 101, the outer surface of the common casing 210, and the outer surface of the cover 206.

As shown in FIG. 2, the annular recess 204 of the impeller 203 has an inner wall surface 211 defined as a locus drawn by a curved line opening laterally of the impeller 203 and containing a circular arc of a radius $r_1$ centered at a point 400 located within the annular recess 204, when the curved line is rotated around the axis of rotation 106*a*. Furthermore, the inner wall surface 211 of the annular recess 204 is formed at its radially outer portion so as to extend along a frusto-conical surface $l_1$ diverging towards the arcuate recess 202 of the common casing 201. The inner wall surface 211 of the annular recess 204 is formed at its radially inner portion 204C so as to extend along a cylindrical surface $l_3$ centered at the axis of rotation 106*a*. On the other hand, the impeller 203 has, at the extremes of the radially outer portion 204*a*, an outer wall surface 212 which is formed so as to extend along a cylindrical surface centered at the axis of rotation axis 106*a*. Each blade has a radially outer end portion 205*a* which extends towards the arcuate recess 202 beyond the annular recess 204 and is arranged on an extension of the cylindrical outer wall surface 212 of the impeller 203. An end portion 215 formed by the inner wall surface 211 and the outer wall surface 212 of the impeller 203 extends to a position where the end 215 contacts a plane $l_4$ which intersects the axis of rotation 106*a* at a right angle and contains the point 400 at which the inner wall surface of the annular recess 204 is centered.

On the other hand, the arcuate recess 202 has an inner wall surface 214 defined as a locus of a curved line opening laterally of the impeller 203 and containing a circular arc of a radius $r_2$ centered at a point 401 located outside the annular recess 204, when the curved line is rotated around the rotation axis 106*a*. The arcuate recess 202 has, at a radially outer portion 201*a*, an inner wall surface 214 which extends along a frusto-conical surface $l_2$ diverging towards the annular recess 204 of the impeller 203. The peripheral wall 207 extending from the common casing 201 over the radially outermost portion 204*a* of the impeller has an inner wall surface 213 arranged so as to extend along a cylindrical surface centered at the axis of rotation 106*a*. Thus, the inner wall surface 213 of the peripheral surface 207 is connected to the inner wall surface 214 of the arcuate recess 202, and is positioned to face the outer wall surface 212 of the impeller 203 and the radially outer end portion 205*a* of the blade 205 with a small gap left therebetween. In order to attain a sufficient sealing effect, the inner wall surface 213 and the outer wall surface 212 extend to the rear side of the impeller 203 so that they may face each other over a substantial area. The inner wall surface 214 of the arcuate recess 202 is suitably tapered or inclined so as to prevent any abrupt change of a flow direction of air discharged from the impeller 203 and flowing into the arcuate recess 202.

The vortex blower of the invention explained hereinbefore operates in the following manner. As the motor 100 runs, the impeller 203 rotates at a high speed and the air in the pockets defined by adjacent blades 205 in the annular space 204 is displaced by the centrifugal force from the radially inner portion 204*c* of the annular space 204 to the radially outer portion 204*b* of the same. The air then flows along the inner wall surface 211 of the impeller 203 and the inner wall surface 213 of the peripheral wall 207 so that the air is discharged to the radially outer portion 201*a* of the arcuate recess 202 from the radially outermost portion 204*b* of the impeller 203. Thus, the air leaves the impeller 203 in a direction substantially tangential to the inner wall surface 211 and flows into the arcuate recess 202 in such a manner so as to make a slight collision with the inner wall surface 214 of the radially outer portion 201*a*. Therefore, the air flowing in the radially outer portion 204*a* of the impeller 203 still has a flow vector or component directed radially outwardly or in a direction in which the centrifugal force acts. In addition, the flow of air is not further deflected radially inwardly, so that the radially outward flow vector is never extinguished. Therefore, even if there is slight dust suspended by the air, no separation of dust from the air takes place and the dust is discharged into the arcuate recess 202 of the common casing 201. Furthermore, the air discharged from the impeller 203 flows into the arcuate recess 202 while making a slight collision with the inner wall surface 213 of the peripheral wall 207 and the inner wall surface 214 of the arcuate recess 202 connected to the inner wall surface 213, so that a sufficient stirring action is effected on the dust in the air stream to avoid any deposition of the dust on these surfaces. The flow of air, introduced into the arcuate recess 202, is progressively deflected as it moves along the inner wall surface 214 from the radially outer portion 201*a* to the radially inner portion 201*b* and is introduced again into the radially inner portion 204*c* of the annular recess 204 in the impeller 203 from the radially inner portion 201*b* of the arcuate recess 202. As the air repeatedly flows between the arcuate recess 202 in the common casing 201 and the annular recess 204 of the impeller 203, the air is energized and pressurized by the impeller. The pressurized air is discharged through the discharge port opening in the common casing 201 and the silencer 300 connected thereto. Meanwhile, new or fresh air is drawn in into the annular recess 202 through the suction port opening in the common casing 201 and the silencer 300 connected thereto.

As stated before, in the conventional vortex blower, the operation of the blower is often hindered by the dust which is inevitably contained in the air even when a filtration or separation device is provided on the suction port. According to the invention, however, the blower 200 can operate safely even if slight dust is contained in the air drawn through the filtration device or separation device. Therefore, according to the invention, the unfavorable problem of mass unbalance of impeller 203 due to separation or dropping of deposited dust, which causes vibration of the impeller 203, can be avoided, and therefore various problems can be eliminated thereby remarkably improving the durability of the vortex blower 200. In addition, since the invention can be carried out without substantial reduction in the area of flow passage of air, it is possible to maintain a sufficiently high aerodynamic performance. Furthermore, since a part of the wall of the impeller 203 is removed, the mass or weight of the impeller 203 is reduced to permit the electric motor 200 to have a small driving torque and a shortened start-up time. Needless to say, the invention also offers an advantage in the aspect of maintenance, such as elimination of disassembling and cleaning of the vortex blower 200 for the purpose of removing the dust.

As a result or experiments, it has been confirmed that superior operation characteristics are obtainable when the shape of a space formed by the combination of the arcuate recess 202 and the annular recess 204 approaches a circular form, as viewed in cross-section taken along a plane containing the axis of rotation 106*a*, or viewed in cross-section shown in FIG. 2. It has also been confirmed that the better result is obtained when the length $m_1$ of the line extending along the inner wall surface 211 of the annular recess 204 and the radially outer end portion 205*a* of the impeller 205 is selected to be 105% to 100% of a length $m_2$ of the line extending along the inner wall surface 214 of the arcuate recess 202, and when the area of the blade 205 is made somewhat greater than the cross-sectional area of the half ($\frac{1}{2}$) of the space formed by the combination of the recesses 202, 204, or when the area of the blade 205 is selected to be somewhat greater than the cross-sectional area of the arcuate recess 202.

Figure 3:
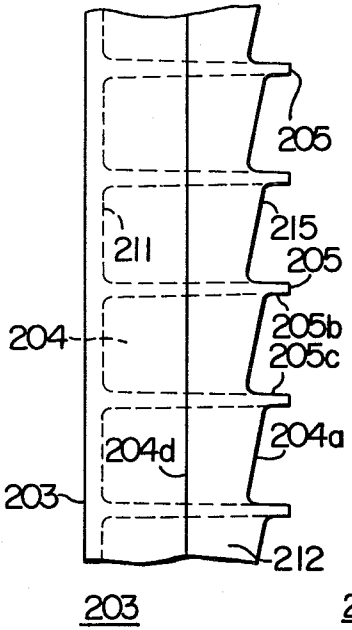
FIG. 3 is a developed view of a part of an impeller incorporated in a vortex blower of another embodiment.

In the embodiment of FIG. 3, the end portion 215 of the impeller 203, formed at the radially outer portion 204*a* of the annular recess 204 and opposing to the radially outer portion 201*a* of the arcuate recess 202, is profiled in a saw-tooth form, as viewed in a circumferential direction of the impeller 203. The end portion 215 is also so shaped so that the end portion 215 is spaced apart from the arcuate recess 202 gradually increasingly from a rear face 205*b* of each blade 205 towards a front face 205*c* of the blade 205, as viewed in a direction of rotation of the impeller 203. The dust suspended in the air tends to be more likely deposited on the front face 205*c* of the blade 205 within the impeller 203. Thus, the arrangement in which the wall surface portion of the impeller 203 adjacent to the front face 205*c* of the blade 205 is spaced apart from the arcuate recess 202 by a larger distance enables deposition of dust in the impeller 203 to be more effectively suppressed. The cylindrical outer wall surface 212 of the radially outer portion 204*a* of the impeller 203 extends to the area denoted by a line 204*d*.

Figure 4:
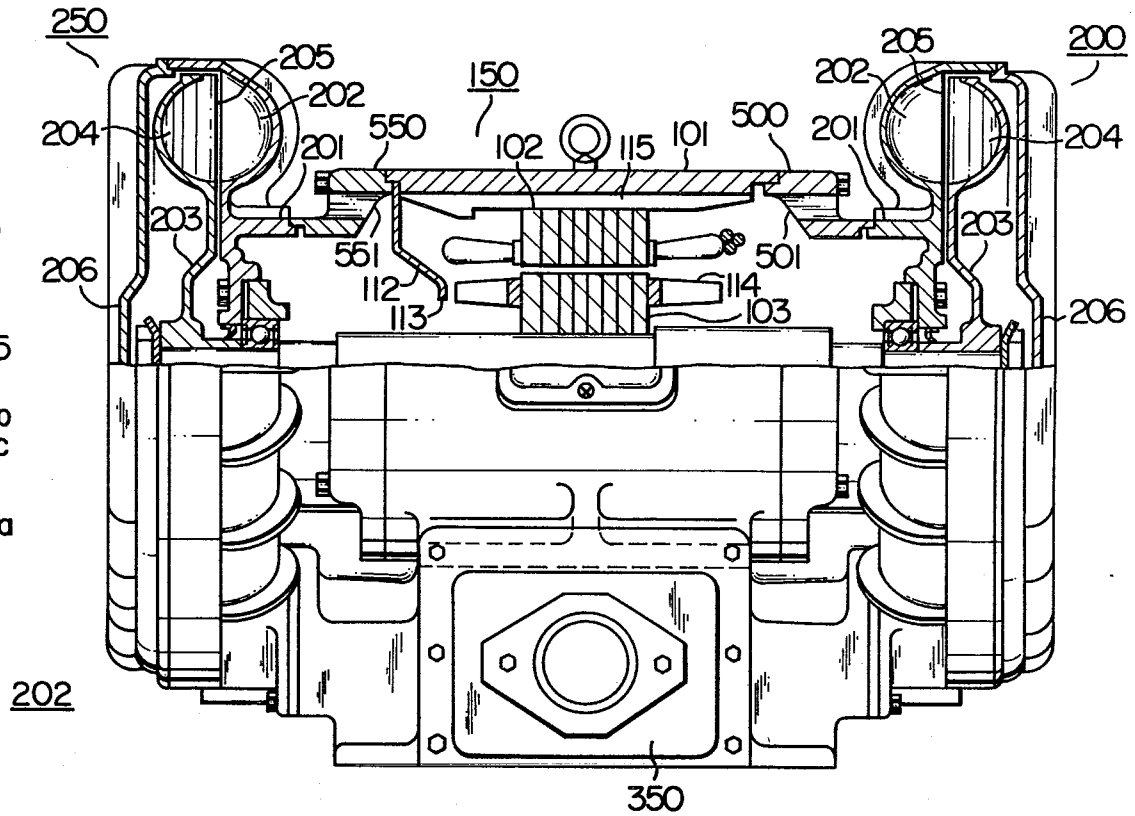
FIG. 4 is a sectional view of a vortex blower in accordance with a third embodiment in which two vortex blowers are secured to a common shaft of an electric motor.

In FIG. 4, unlike the preceding embodiments described hereinabove in which one vortex blower is coupled to one electric motor, two vortex blowers are connected to a common electric motor, with the first vortex blower 200 is connected to one end of a common rotary shaft of an electric motor generally designated by the reference numeral 150, while a second vortex blower generally designated by the reference numeral 250 is connected to the other end of the common rotary shaft. The construction of the first and second vortex blowers 200, 250 may be same as those explained with reference to FIGS. 1 and 2 and, therefore, detailed description is omitted here. The use of the electric motor 150 having such a common rotary shaft makes it difficult to effectively cool the motor. Therefore, in the embodiment of FIG. 4, the vortex blowers 200 and 250 are connected to the electric motor 15 through coupling or connecting members 500 and 550, respectively. Each of these two connecting members 500 and 550 has a double cylindrical structure and is connected, at its larger-diameter portion, to the corresponding one of opposite ends of the housing 101 of the motor 150 and, at its smaller-diameter portion to the common casing 201 of the corresponding vortex blower 200, 250. Ventilation ports 501 and 551 are formed in respective connecting members 500 and 550, and a fan guide 112 is disposed between the housing 101 of the electric motor 150 and the connecting member 550. The fan guide has a disc-like form provided at its center with an opening 113 disposed in a vicinity of the ends of cooling blades 114 secured to the end surface of the rotor 103. Air passages 115 are defined between the rear side of the stator 102 and the inner surface of the housing 101. According to this arrangement, the ambient air is drawn by the action of the cooling blades 114 through the ventilation port 551 of the coupling member 550 and flows along the surface of the fan guide 112, as the electric motor 150 is rotated. Then, the air is discharged to the outside of the electric motor 150 through the air passage 115 and the ventilation port 501 of the coupling member 550. Thus, it will be seen that the electric motor 150 is effectively cooled by the flow of air. In this embodiment of FIG. 4, it is to be noted that it is possible to obtain an air discharge rate which is twice as large as that obtained when one of the first and second vortex blowers 200 and 250 is used solely, by operating the blowers in a parallel connection, i.e. by connecting the suction ports formed in the common casings 201 of the first and second blowers 200, 250 to each other, as well as the discharge ports to each other.

It is also to be noted that it is possible to obtain an air discharge pressure twice as high as that obtained when one of the first and second vortex blowers 200, 250 are operated solely, by operating the blowers 200, 250 in a series connection, i.e. by connecting the discharge port formed in the common casing 201 of the first vortex blower 200 to the suction port formed in the common casing 201 of the second vortex blower 250. In this embodiment, two silencers 350 are arranged with their longitudinal axes arranged in series and extending at a right angle to the axis of rotation of the electric motor 150.

What is claimed is:

1. A vortex blower comprising:

a rotor shaft having an axis of rotation;

an impeller fixed to said rotor shaft;

an annular recess defined by an inner wall surface formed in said impeller and laterally opening around said rotation axis;

a casing disposed to face said impeller and cover a radially outer portion of said impeller, said casing having a cylindrical peripheral wall;

a suction portion and a discharge port formed in said casing;

an arcuate recess formed around said rotation axis in a portion of said casing which extends between said suction port and said discharge port and opposes said annular recess; and a plurality of blades provided in said annular recess to divide said annular recess into a plurality of circumferentially arranged pockets and each having a radially outer end portion extending towards said arcuate recess beyond an end portion of a radially outer portion of said annular recess, said radially outer end portion of each blade being disposed along an inner wall surface of said peripheral wall of said casing with a small gap therebetween.

2. A vortex blower according to claim 1, wherein said annular recess has at a radially outer portion therefore an inner wall surface which extends along a frusto-conical surface diverging towards said casing.

3. A vortex blower according to claim 1, wherein said impeller has a cylindrical radially outer portion, and said casing has a cylindrical inner wall surface which extends from said arcuate recess and is positioned so as to face said cylindrical radially outer portion of said impeller with a small gap formed therebetween.

4. A vortex blower according to claim 1, wherein said annular recess has at a radially outer portion thereof adjacent said arcuate recess an end portion having a saw-tooth configuration, as viewed in a circumferential direction of said impeller.

5. A vortex blower according to claim 4, wherein said end portion of said annular recess is spaced apart from said arcuate recess gradually increasingly from a rear face of said blade towards a front face thereof, as viewed in a direction of rotation of said impeller.

6. A vortex blower according to claim 1, wherein said blade has an area slightly greater than an area of said arcuate recess, as viewed in a cross-section taken along a plane containing said rotation axis.

7. A vortex blower comprising:

a rotor shaft having an axis of rotation;

an impeller fixed to the rotor shaft and having at a radially outermost portion thereof a cylindrical outer wall surface;

an annular recess formed in said impeller around said rotation axis, said annular recess having an inner wall surface comprising a curved line which contains a circular arc centered at a point within said impeller and opens laterally of said impeller, as viewed in a cross section taken along said axis of rotation;

a casing disposed so as to face said impeller and cover a radially outer portion of said impeller, said casing having a cylindrical peripheral wall;

a suction port and a discharge port formed in said casing;

an arcuate recess formed around said axis of rotation in a portion of said casing which extends between said suction port and said discharge port and opposes said annular recess; and a plurality of blades provided in said annular recess to divide said annular recess into a plurality of circumferentially arranged pockets and each having a radially outer end portion extending towards said arcuate recess beyond an end portion of a radially outer portion of said annular recess, said radially outer end portion of each blade being disposed along an inner wall surface of said peripheral wall of said casing with a small gap therebetween.

8. A vortex blower according to claim 7, wherein said radially outer end portion of each blade is positioned so as to extend from a cylindrical outer wall surface of said impeller.

9. A vortex blower according to claim 7, wherein said annular recess has at a radially outer portion thereof an end portion which extends to a plane intersecting said rotation axis at a right angle and containing said point at which said circular arc of said annular recess is centered.

10. A vortex blower according to claim 7, wherein said annular recess has at a radially outer portion thereof an inner wall surface which extends along a frusto-conical surface diverging towards said casing, and at its radially inner portion an inner wall surface which extends along a cylindrical surface centered at said rotation axis.

11. A vortex blower according to claim 8, wherein said annular recess has at a radially outer portion thereof adjacent said arcuate recess an end portion have a saw-tooth configuration, as viewed in a circumferential direction of said impeller.

12. A vortex blower according to claim 11, wherein said end portion of said annular recess is spaced apart from said arcuate recess gradually increasingly from a rear face of said blade towards a front face thereof, as viewed in a direction of rotation of said impeller.

13. A vortex blower according to claim 7, wherein said blade has an area slightly greater than an area of said arcuate recess, as viewed in a cross-section taken along a plane containing said rotation axis.

* * * * *